US008861767B2

(12) United States Patent
Lee et al.

(10) Patent No.: US 8,861,767 B2
(45) Date of Patent: Oct. 14, 2014

(54) HEADPHONES WITH INTERCHANGEABLE DECOR STRIP

(75) Inventors: Noel Lee, Las Vegas, NV (US); Jacky Hsiung, San Jose, CA (US); Kendrew Lee, Tsing Yi (HK)

(73) Assignee: Monster, LLC, Brisbane, CA (US)

( * ) Notice: Subject to any disclaimer, the term of this patent is extended or adjusted under 35 U.S.C. 154(b) by 0 days.

(21) Appl. No.: 13/598,466

(22) Filed: Aug. 29, 2012

(65) Prior Publication Data

US 2013/0136293 A1 May 30, 2013

Related U.S. Application Data

(60) Provisional application No. 61/530,297, filed on Sep. 1, 2011.

(51) Int. Cl.

| | |
|---|---|
| ***H04R 25/00*** | (2006.01) |
| ***H04R 1/10*** | (2006.01) |
| ***H04R 5/033*** | (2006.01) |
| *H04R 29/00* | (2006.01) |

(52) U.S. Cl.

CPC ..... *H04R 1/10* (2013.01); *H04R 5/0335* (2013.01); *H04R 29/008* (2013.01)

USPC ..... 381/370; 381/374

(58) Field of Classification Search

USPC ..... 381/370, 374

See application file for complete search history.

(56) References Cited

U.S. PATENT DOCUMENTS

| | | | | | |
|---|---|---|---|---|---|
| 5,581,627 | A | * | 12/1996 | Bowser et al. | 381/370 |
| 5,826,597 | A | * | 10/1998 | Chou | 132/273 |
| D604,268 | S | * | 11/2009 | Choe | D14/205 |
| D666,992 | S | | 9/2012 | Lee | |

* cited by examiner

*Primary Examiner* — Davetta W Goins
*Assistant Examiner* — Amir Etesam
(74) *Attorney, Agent, or Firm* — Sentinel IP; John Nielsen

(57) ABSTRACT

Audio headphones for personalizing a wearer's headphones by inserting a variety of interchangeable décor strips onto a headband of the headphones. The interchangeable décor strips may include many different designs, colors and materials.

6 Claims, 6 Drawing Sheets

HEADPHONES WITH INTERCHANGEABLE DECOR STRIP

CROSS REFERENCE TO RELATED APPLICATIONS

The present application claims the priority of U.S. Provisional Patent Application Ser. No. 61/530,297, entitled "Headphones with Interchangeable Décor Strip", filed Sep. 1, 2011, which application is incorporated in its entirety herein by reference.

TECHNICAL FIELD

The present invention is generally related to headphones, and more particularly is related to headphones with an interchangeable decorative strip.

BACKGROUND ART

The fields of technology, art, and fashion have long been merging. Our efforts to personalize our otherwise ubiquitous modern devices are ongoing, and form an important part of many people's efforts to express and differentiate themselves. Unfortunately, commonly worn headphones continue to lack features enabling expression of individual taste and style.

BRIEF SUMMARY OF THE INVENTION

The present invention addresses the above and other needs by providing audio headphones which, allows a wearer to personalize the headphones by inserting a variety of interchangeable décor strips onto a headband of the headphones. The interchangeable décor strips may include many different designs, colors and materials. In one embodiment, the headband is configured to accommodate the interchangeable décor strips so as to provide the appearance that the interchangeable décor strips is integral to the headphones as a whole.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

BEST MODES FOR CARRYING OUT THE INVENTION

The following description is of the best mode presently contemplated for carrying out the invention. While the invention herein disclosed has been described by means of specific embodiments and applications thereof, this description is not to be taken in a limiting sense, but is made merely for the purpose of describing one or more preferred embodiments of the invention. Numerous modifications and variations could be made thereto by those skilled in the art without departing from the scope of the invention set forth in the claims. The scope of the invention should be determined with reference to those claims.

Figure 1:
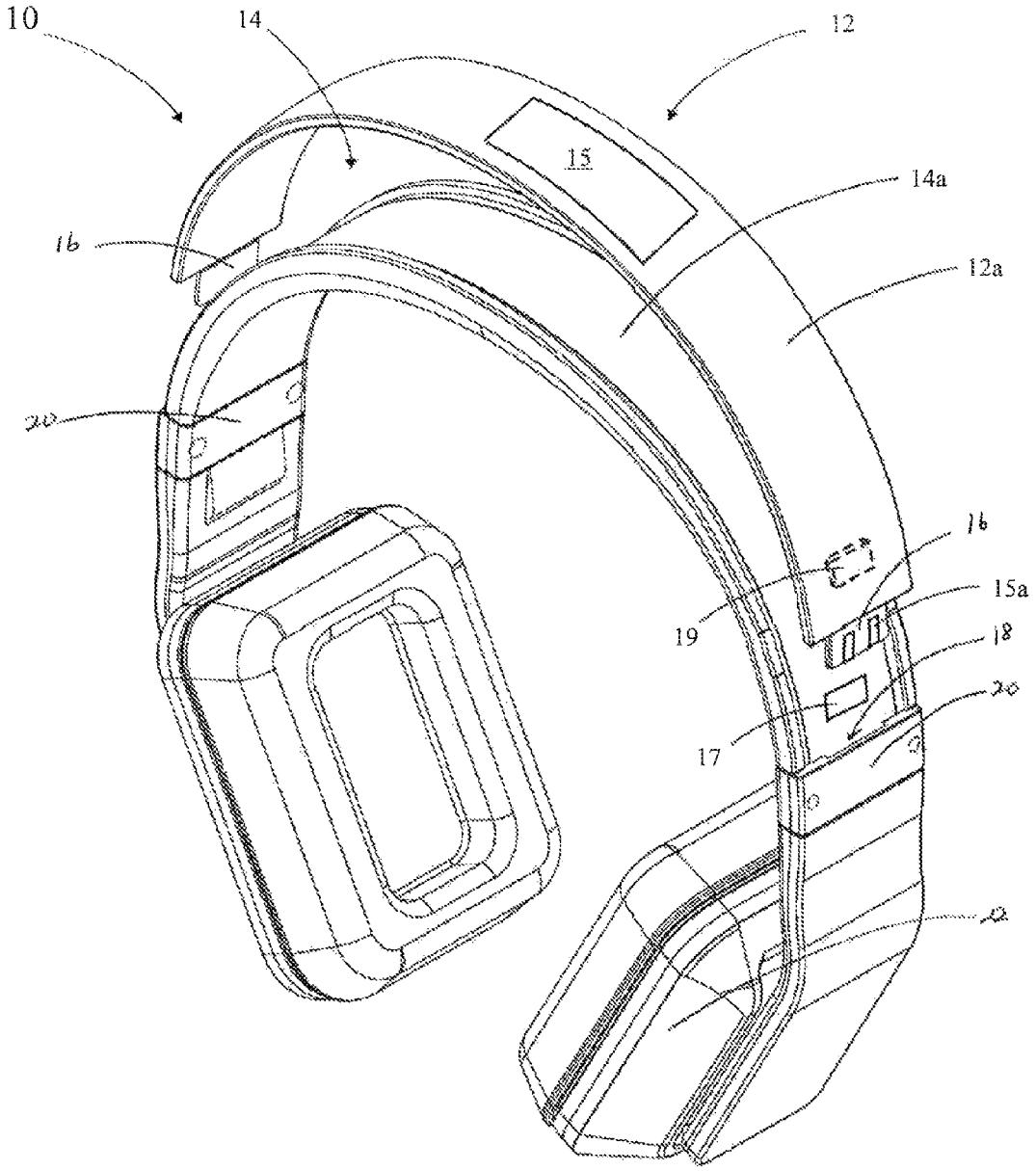
FIG. 1 is a perspective view of the invention, showing a detached interchangeable décor strip and the headphone/headband assembly according to the present invention.

FIG. 1 is a perspective view of the headphone assembly 10, showing a detached interchangeable décor strip 12. The headphone assembly 10 includes an arced headband 14 reaching over a wearer's head, two ear pieces 22 providing a volume around a wearer's ears and including speakers, headband ends 20 connecting the ear pieces 22 to the headband 14 and preferably providing adjustment of the headphone assembly 10, and the décor strip 12. The décor strip 12 may be made from a large variety of materials, or combinations thereof, including but not limited to plastic, wood, fabric or leather (with an appropriate support structure). The décor strip 12 may incorporate different colors, patterns, writings, numbers, designs, logos, and any combination thereof. The décor strip 12 may include an electronic component 15, for example, a photo voltaic material, which could provide some or all of the power to a cooperating sound production device. The décor strip surface 12*a* may include florescent or other luminous material. The décor strip 12 may display static or changing messages, including where the changing 'messages' include visible representations, such as pulses, showing the beat of music being played through the ear pieces 22. The décor strip 12 is removable and interchangeable with other décor strips to allow the wearer to change the appearance of the assembly 10.

The décor strip 12 may be attached to a headband 14 of the headphone assembly 10 in a variety of ways. A tongue and slot configuration is shown in FIG. 1 where the décor strip 12 includes tongues (or protrusions, tab, lips, projections, etc) 16 located on opposite ends of the décor strip 2 and the headband 14 includes the slots (or, grooves, apertures, channels, recesses, depressions etc.) 18 located near opposite ends of the headband 14. The tongues 16 and the slots 18 are sized appropriately to provide a secure fit to the décor strip 12. The tongue and slot configuration may be reversed, with the décor strip 16 having slots and the headband 14 having tongues. The slots 18 may be provided by the headband piece 20 having gaps on its underside, sized and shaped so as to accommodate the tongues 16. The tongues 16 may include electrical contacts 15*a* for connecting an electronic component 15 on the décor strip 12 to the headphone assembly 10.

The headphone assembly 10 may also include magnetic elements to assist in securing the décor strip 12 by making the tongues 16 and/or material around the slots 18 elements magnetically attractive to each other, or by including one or more magnets 17 in the headphone assembly 10. The magnetic embodiment could also include magnets 19 in the décor strip 12, creating magnetic attraction between other portions of the décor strip 12 and the headband 14. Further, the headband pieces 20 could be magnetized headband pieces (preferably permanently) so as to assist with securing the décor strip 12 to the headband 14.

Figure 8:
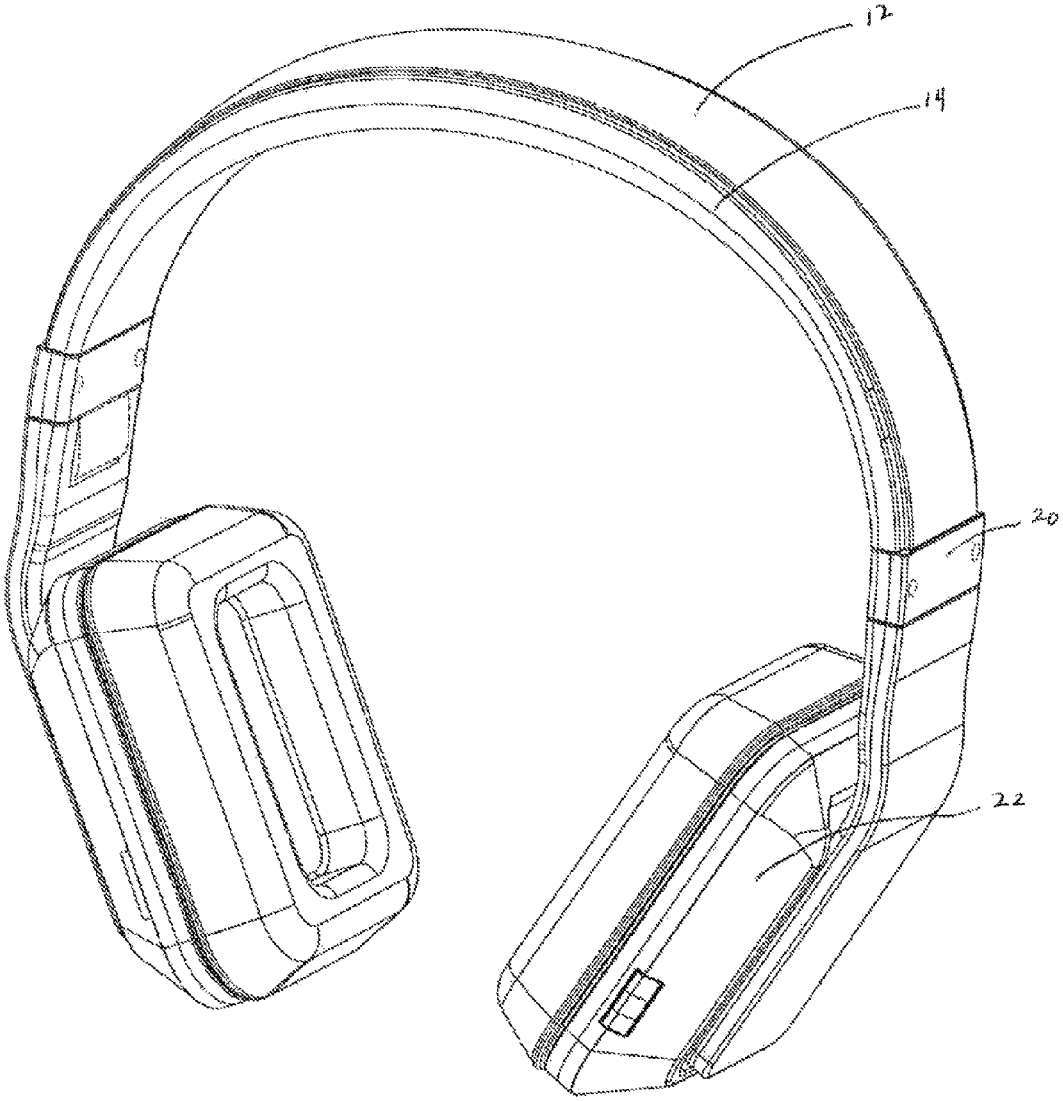
FIG. 8 is a perspective view of the headphone/headband assembly according to the present invention, showing the headphone assembly with the décor strip mounted.

Other means for attaching or connecting the décor strip 12 to the headband are not shown in the drawings, but could include fasteners, snaps, buttons, hook and loop material, or other physical locking mechanisms. Preferably, the headband 14 includes a recessed top surface 14*a* which both assists in positioning and/or securing the décor strip 12, and also allows the décor strip 12 (when attached) to appear as an integral portion of the device 10, as shown in FIG. 8, where the décor strip 12 is shown mounted onto the headband 14. The attachment means may also provide electrical and/or data communication between the headband and the décor strip.

While FIG. 1 depicts magnets 17 or 19 near the ends of the décor strip 12, where magnets are used in other embodiments (not pictured), the magnets may be disposed anywhere along the underside of the décor strip 12, along recessed top surface 14*a*, or both. Where magnets are used solely along the underside of the décor strip 12, a magnetically attractable material (e.g., ferrous material, another magnet, an electromagnet, etc.) would be disposed along corresponding places on the recessed top surface Ha. Conversely, where magnets are disposed solely along the recessed top surface 14*a*, a magnetically attractable material would be disposed along corresponding places on décor strip 12. In embodiments where magnets are used, any number of magnets or magnetically attractable materials may be used to secure the décor strip 12 in place.

Figure 2:
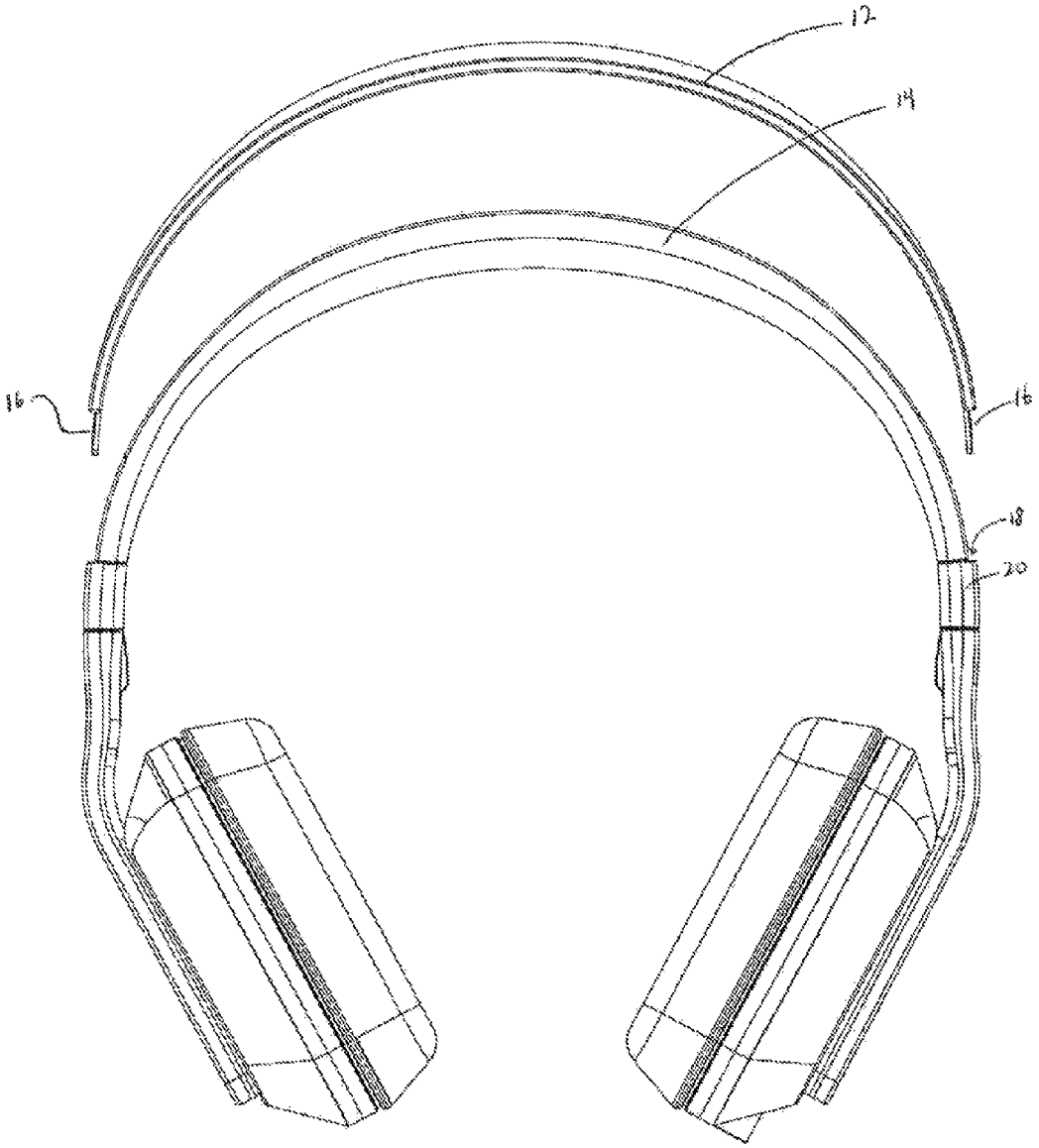
FIG. 2 is a front view of the dismounted interchangeable décor strip and the headphone/headband assembly according to the present invention.
Figure 3:
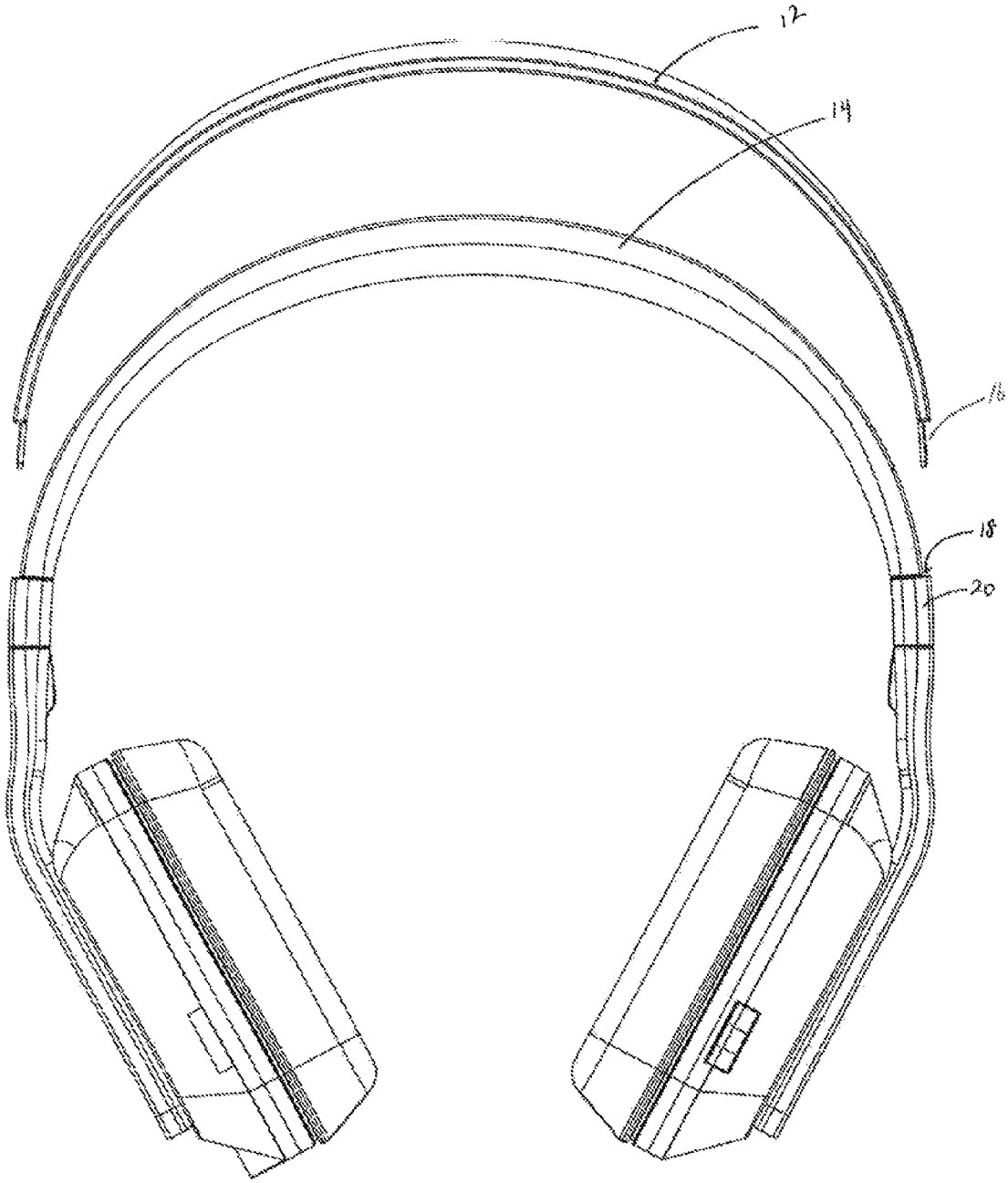
FIG. 3 is a rear view of the dismounted interchangeable décor strip and the headphone/headband assembly according to the present invention.

FIGS. 2 and 3 show front and rear views of the headphone assembly 10 with the décor strip 12 shown detached from the headband 14. These figures also show the invention utilizing the protrusion 16 and slot 18 configuration.

Figure 4:
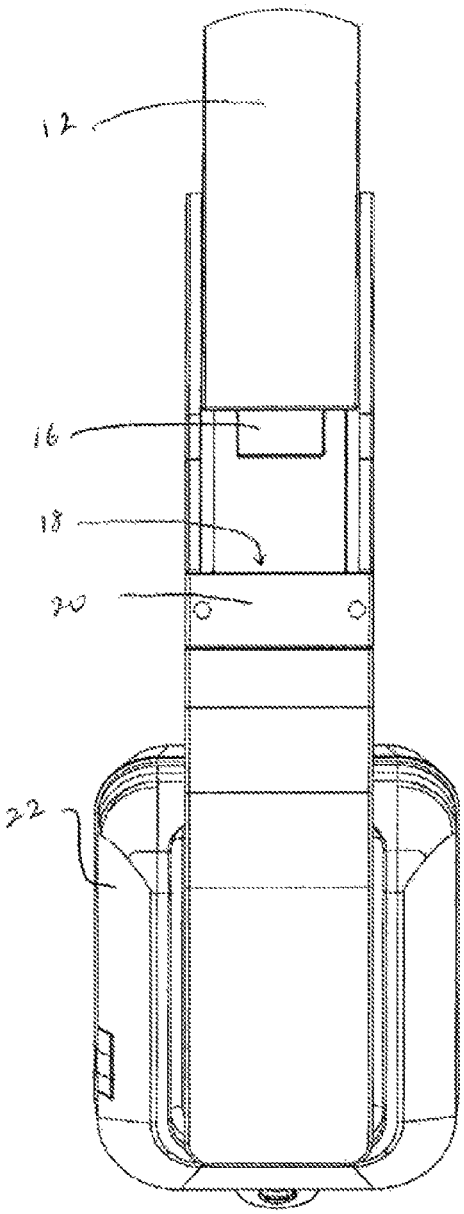
FIG. 4 is a side view of the dismounted interchangeable décor strip and the headphone/headband assembly according to the present invention.
Figure 5:
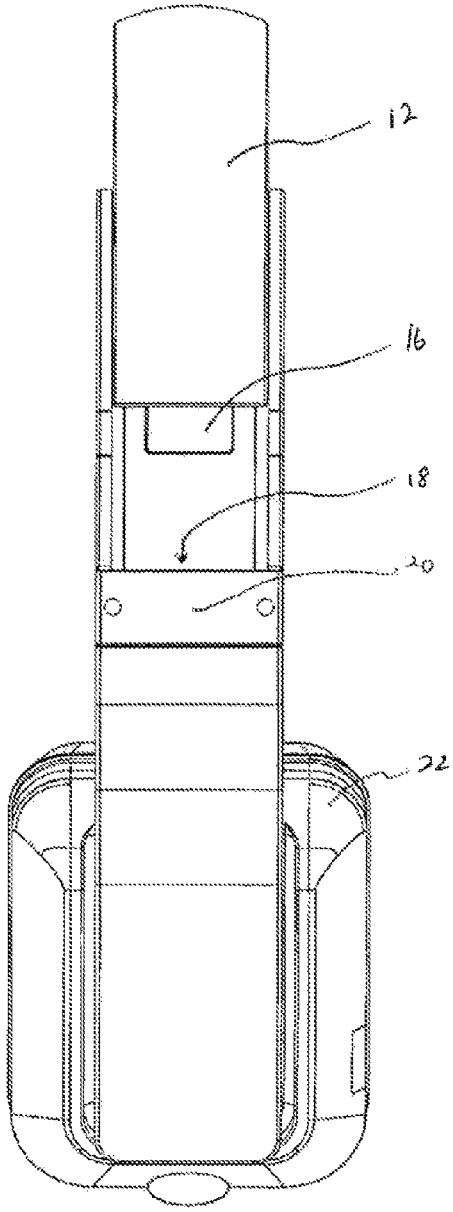
FIG. 5 is an opposing side view of the dismounted interchangeable décor strip and the headphone/headband assembly according to the present invention.

FIGS. 4 and 5 show side views of the headphone assembly 10 with the décor strip 12 shown detached from the headband 14. These figures also show the tongue 16 and slot 18.

Figure 6:
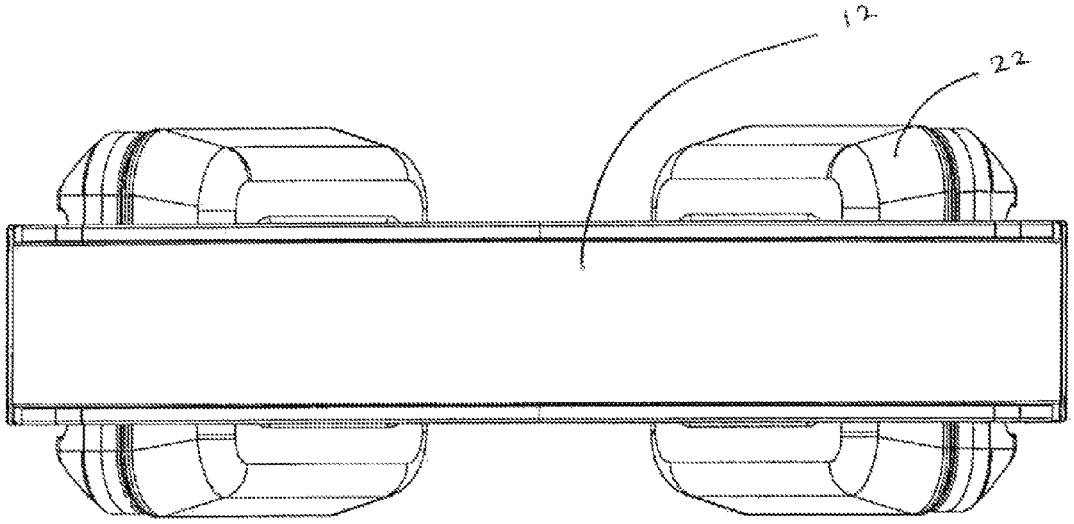
FIG. 6 is a top view of the dismounted interchangeable décor strip and the headphone/headband assembly according to the present invention.

FIG. 6 is a top view of the headphone assembly 10, showing the décor strip 12 positioned over the headband.

Figure 7:
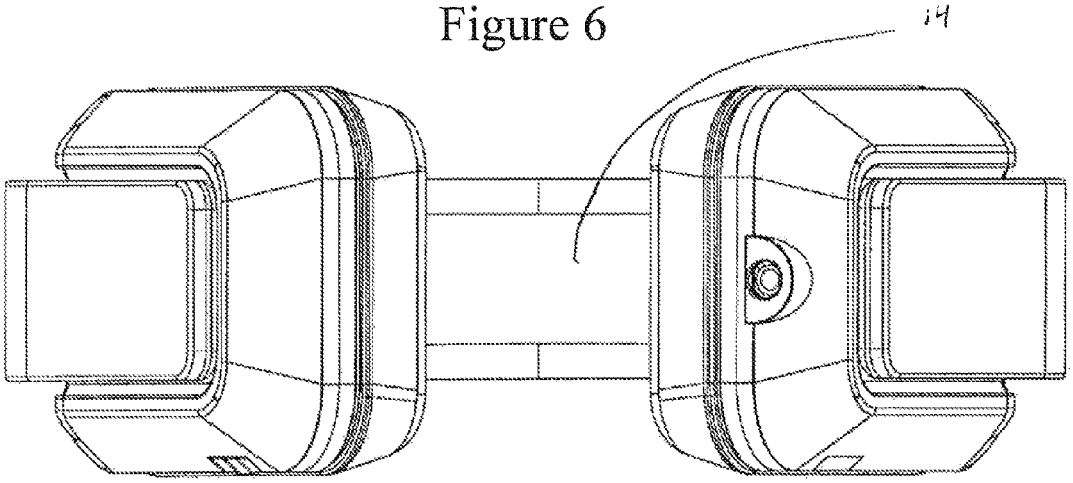
FIG. 7 is a bottom view of the dismounted interchangeable décor strip and the headphone/headband assembly according to the present invention.

FIG. 7 is a bottom view, showing the underside of the headband 14. The décor strip 12 is not visible in this view.

FIG. 8 is a perspective view of the invention, showing the headphone assembly with the décor strip 12 mounted onto the headband 14. As shown, the décor strip 12 becomes an integral element to the device 10 as a whole when secured in this position. The décor strip 12 lays directly on the headband 14 seamlessly.

INDUSTRIAL APPLICABILITY

The present invention is industrially applicable to audio listening devices.

We claim:

1. A headphone assembly with an interchangeable decor strip, the headphone assembly comprising:

a. A headband for reaching over a wearer's head and having a top surface, a first headband end, and a second headband end;

b. A first ear piece and a second ear piece, the first and second ear pieces including speakers and configured to wear over a wearer's ears, the first ear piece coupled to the first headband end and the second ear piece coupled to the second headband end; and c. A removable and replaceable decor strip having a first decor strip end and a second decor strip end, the decor strip being disposed on the top surface of the headband, the first decor strip end being coupled to the first headband end and the second decor strip end being coupled to the second headband end; and d. an electronic component where attachment of the decor strip to the headband electrically connects the electronic component to the headphone assembly.

2. The headphone assembly of claim 1, wherein the electronic component comprises a photo voltaic material, for providing some of a power source to a cooperating sound production device.

3. The headphone assembly of claim 1, wherein the electronic component comprises a light emitting material.

4. The headphone assembly of claim 3, wherein the light emitting material generates a message.

5. The headphone assembly of claim 3, wherein the light emitting material generates pulses, the pulses showing the beat of music being played through the ear pieces.

6. A headphone assembly with an interchangeable decor strip, the headphone assembly comprising:

A. a headband for reaching over a wearer's head and having a top surface;

B. a pair of ear pieces including speakers and configured to enclose a wearer's ears;

C. a pair of headband ends at each end of the headband and connecting the ear pieces to the headband;

D. a removable and replaceable decor strip attachable to the top surface of the headband by tongues on the ends of the decor strip engaging slots in the headband ends, the decor strip being visible when the headphone assembly is worn by a wearer; and E. where the decor strip further comprises an electronic component whereby attachment of the decor strip to the headband electrically connects the electronic component to the headphone assembly through the engagement of the tongues and the slots.

* * * * *